US009107510B2

(12) United States Patent
Ead

(10) Patent No.: US 9,107,510 B2
(45) Date of Patent: Aug. 18, 2015

(54) HOSPITAL BED FOR AUTOMATICALLY CHANGING SHEETS

(71) Applicant: Ultimate Comfort n Care Products LLC, Providence, RI (US)

(72) Inventor: Nimer Mohammed Ead, Providence, RI (US)

(73) Assignee: Ultimate Comfort n Care Products LLC, Providence, RI (US)

( * ) Notice: Subject to any disclaimer, the term of this patent is extended or adjusted under 35 U.S.C. 154(b) by 51 days.

(21) Appl. No.: 14/214,302

(22) Filed: Mar. 14, 2014

(65) Prior Publication Data

US 2014/0259407 A1 Sep. 18, 2014

Related U.S. Application Data

(60) Provisional application No. 61/784,948, filed on Mar. 14, 2013.

(51) Int. Cl.

| | |
|---|---|
| ***A47C 21/02*** | (2006.01) |
| ***A61G 7/057*** | (2006.01) |
| ***A61G 7/05*** | (2006.01) |
| ***A47C 27/08*** | (2006.01) |

(52) U.S. Cl.

CPC ..... *A47C 21/028* (2013.01); *A47C 27/083* (2013.01); *A61G 7/0502* (2013.01); *A61G 7/057* (2013.01); *A61G 7/0573* (2013.01); *A61G 7/05769* (2013.01)

(58) Field of Classification Search

CPC .. A47C 21/028; A47C 27/083; A61G 7/0573; A61G 7/057; A61G 7/05769; A61G 7/0502

See application file for complete search history.

(56) References Cited

U.S. PATENT DOCUMENTS

| | | | | |
|---|---|---|---|---|
| 6,006,378 | A | 12/1999 | Hayashi | |
| 6,594,837 | B2 | 7/2003 | Khait | |
| 7,191,479 | B1 * | 3/2007 | Cheng | 5/600 |
| 7,895,688 | B1 * | 3/2011 | Rowes et al. | 5/612 |
| 8,719,980 | B2 * | 5/2014 | Chen | 5/613 |
| 2011/0072582 | A1 * | 3/2011 | Patterson et al. | 5/484 |
| 2011/0214233 | A1 * | 9/2011 | Stang | 5/488 |
| 2012/0159709 | A1 * | 6/2012 | Nguyen | 5/488 |
| 2013/0291309 | A1 * | 11/2013 | Koorey | 5/658 |

* cited by examiner

*Primary Examiner* — Robert G Santos
*Assistant Examiner* — David E Sosnowski
(74) *Attorney, Agent, or Firm* — Knobbe, Martens, Olson & Bear LLP

(57) ABSTRACT

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bedsheets while the hospital bed is occupied by a patient. The present invention also comprises of a medical bed apparatus which allows the seamlessly changing of a used bed sheet with a new bed sheet while the bed is occupied by a person, and a method thereof.

18 Claims, 10 Drawing Sheets

HOSPITAL BED FOR AUTOMATICALLY CHANGING SHEETS

CROSS-REFERENCE TO RELATED APPLICATION

The instant patent application claims priority to and the benefit of U.S. Provisional Patent Application Ser. No. 61/784,948, filed on Mar. 14, 2013, titled "MALIX BED, AND A BED APPARATUS CAPABLE OF SEAMLESSLY CHANGING BED-SHEETS WHILE OCCUPIED BY AN IMMOBILE PERSON, AND A METHOD THEREOF", the entire disclosure of which provisional application is incorporated herein by reference.

FIELD OF THE INVENTION

The present invention relates generally to an ultimate comfort n care bed, and a bed apparatus capable of seamlessly changing bed sheets while being occupied by a person, a method of relieving ulcers, and a method thereof. The present invention also relates to a medical or a hospital bed, and, more particularly, to a hospital bed capable of seamlessly changing bed-sheets while the hospital bed is occupied by a patient. The present invention also comprises of a medical bed apparatus which allows the seamlessly changing of a used bed sheet with a new bed sheet while the bed is occupied by a person, and a method thereof.

BACKGROUND INFORMATION

Hospital beds have been known and have been used for many years, and under a variety of applications.

Existing hospital beds, including various kinds of hospital beds, the patient must be moved before changing bed sheets. In many cases the disabled or some patients cannot leave the bed without the help of others. This is a hardship for patient family members and the nurses, and more importantly, it may cause pain and discomfort to the patients. For those who are injured in the cervical vertebra or the vertebra, suffering from various kinds of serious injuries, or a patient recovering from a surgery, it often causes secondary injury if the patient is moved, and this also further hinders patient recovery.

Changing bed linens in a hospital or healthcare facility is necessary and advantageous. It allows the hospital staff and patients to promote cleanliness and prevents unnecessary infections, ulcers, injuries, or losing expensive hard-to-replace items. Changing the bed linen while the patient is still on the hospital bed carries significant challenges, both for the patient, and the caregiver. Multiple steps need to be taken to make the task possible. However, these steps are not without drawbacks and limitations, for example:

(1) Making arrangements for assistance: Assistance is required whether one is at a hospital, a skilled nursing facility, or at home. If one is at the home, then one would need a friend or a family member who would be willing to help out;

(2) Scheduling helpers: Learning how to provide the care needed without straining ones back or otherwise injuring oneself is not only important but it is very challenging too;

(3) Positioning the bed: The quality of the bed and adjustability are very crucial, trying to work with a non-adjustable medical bed is not practical, as it will make bedside care extremely difficult. Further it requires more people and this creates a crowded area around the bed, which restricts maneuverability, such as, having two to four people doing the task;

(4) Raising and lowering the ends of the bed: For example, when patients have congestive heart failure or respiratory disease, a hospital bed's ability to raise the head of the bed up will greatly help the patient to breathe more easily, moving the patient out of the bed or rolling him on either side or lifting him up;

(5) Side rails and safety: Side rails and safety are extremely important to have if the patient is confused or may become confused in the future, and this also prevents a patient from falling out of the medical bed;

(6) Keeping linens flat and smooth: Wrinkles in the bed, or the bed sheet, or any debris will irritate the skin and cause discomfort as well as injury to the skin. Some patients become so sensitive that they cannot tolerate anything at all lying on top of their feet, even a bed sheet;

(7) Need to reposition patient up in bed: If assistance is not provided, the patient remains slumped down too far toward the foot of the bed and will not only feel uncomfortable, but the position can interfere with ease in breathing and also cause unnecessary pressure on the base of the spline and result in skin breakdown;

(8) Need to avoid dragging: When a patient experiences difficulty turning him or pulling him up in bed, pulling or pushing him without lifting will result in dragging his body across the bed. Dragging him from side to side or up in bed can cause injury to the skin;

(9) Draw bed sheets used to lift or turn: Draw bed sheets used to lift or turn has been widely used to help changing the bed sheet. However, it needs high level of training and it is not without pain and discomfort;

(10) Turning the patient: In hospitals, it is a standard procedure to turn or roll a patient in bed every two hours to avoid skin breakdown and bedsores from developing, as these complication is associated with significant distress to both patient and caregiver and they are extremely difficult to treat when they occur. However, in some cases, at the very end, it will not be appropriate to turn the patient in bed, because this could be more disturbing or painful at the time;

(11) Changing the bed sheets: Changing the bed sheets job is very difficult, especially for the immobilized or paralyzed patient, and it needs a lot of patience and nursing technique. However, changing the bed sheets on a regular basis is extremely important not only because it can help patient feeling more comfortable; but also keeping clean and dry are part of preventing infection, skin breakdown, or bedsores, from happening;

(12) Dealing with urinary Incontinence and bowel Incontinence: If urinary and bowel incontinence are occurring on a regular basis, one will need to place incontinent pads underneath the patient. These can be reusable and washable (made of cloth) or disposable. One will also need to place incontinent briefs to absorb urine and help keep the skin dry. These will need to be changed and washed every few hours as needed as the pads are also used to collect feces and other discharges and must be removed before changing bed sheets.

U.S. Pat. No. 6,006,378 (Mitsuru Hayashi) discloses a bed which permits changing of bedclothes without moving the person on it and without substantial burden for either the patient or the care-taker. A left and a right carriage member 5 and 6, wheels 15 to 18 and a shaft 7 constitute a carriage. The carriage supports mats 11 and 12 via balancing members 3 and 4 and shafts 1 and 2 and advances the mats 11 and 12 along rails 31 and 32. The mat 12 is stretched between the rails 31 and 32 by fasteners. The balancing members 3 and 4 are rotatably coupled by a shaft to downward extensions 5*a* and 6*a* of the carriage members 5 and 6. The shafts 1 and 2 are rotatably mounted in the balancing members 3 and 4. With advancement of the carriage caused by turning a grip 26, the slides 52 and 54 cause the old mat 12 to be released from the fasteners and wound on the shaft 2, while also causing the new mat 11 to be coupled to the fasteners and stretched between the rails 31 and 32.

U.S. Pat. No. 6,594,837 (George Khait) discloses a service bed comprising a chassis, a guide mechanism movably supported by the chassis, and a mattress having an undulation formed by routing the mattress through the guide mechanism. The guide mechanism includes dispensing and collecting rollers for installing at least one first stratum between the mattress and the occupant of the service bed and for removing at least one second stratum installed between the mattress and the occupant.

U.S. Pat. No. 7,191,479 (Xiao-Zhou Cheng) discloses a hospital bed that changes bed sheets without moving the patient. It is composed of a bedstead (including a headboard, a footboard and a bed frame), a deformable bed top, a spool rack and roller shafts on both sides; the ends of the deformable bed top are fixed on the headboard and footboard respectively, and the bed top is pressed into between the roller axles by the spool rack which forms a tightened and leveled bed top that is sunken in the spool rack. Two bed sheets cover the bed, extending respectively from headboard and footboard into the spool rack and rolling on a roller axle. The roller axles and roller shafts are parallel to the cross section of the bed, and are movable between the headboard and footboard with the spool rack. When the spool rack is moving, one bed sheet is spread, another one is rolled up automatically.

This invention improves on the deficiencies of the prior art and provides an inventive bed apparatus which allows the seamlessly changing of bed-sheets while the bed is occupied by a person, and a method thereof.

PURPOSES AND SUMMARY OF THE INVENTION

The invention is a novel ultimate comfort n care bed, and a bed apparatus capable of seamlessly changing bed sheets while being occupied by a person, a method of relieving ulcers, and a method thereof.

The inventive hospital bed contains multiple features that allow spool rack to transverse freely across a hospital bed mattress while removing/dispensing bed-sheets without moving the patient.

The inventive hospital bed also incorporates features that reduce the force required to move carriage assembly across the bed using a pulley assembly, a roller assembly, air bladders, belts, and any combination of them.

Therefore, one purpose of this invention is to provide a cost effective and durable hospital bed capable for allowing of seamlessly changing bed sheets while being occupied by a patient.

Another purpose of this invention is to provide a hospital bed where the changing mechanism for the bed sheets is below a patient and does not interfere with the comfort of the patient.

Another purpose of this invention is to provide an inventive mechanism where while a used bed sheet is being removed from the medical bed a new bed sheet is automatically being replaced in its place.

Therefore, in one aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said master bed frame, such that said primary mattress is positioned between said headboard and said footboard;

(c) at least one carriage assembly in engagement contact with said primary mattress and wherein said at least one carriage assembly is positioned between said headboard and said footboard; and (d) at least one means to move said at least one carriage assembly over said primary mattress from a first position to a second position.

In another aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said master bed frame, such that said primary mattress is positioned between said headboard and said footboard;

(c) at least one carriage assembly in engagement contact with said primary mattress and wherein said at least one carriage assembly is vertically positioned between said headboard and said footboard, such that said at least one carriage assembly is substantially parallel to said headboard and said footboard; and (d) at least one means to move said at least one carriage assembly over said primary mattress from a first position to a second position.

In yet another aspect this invention comprises a medical bed apparatus for seamlessly changing bed sheets, comprising:

(a) a master bed frame having a first end and a second end, wherein said first end is secured to a headboard, and said second end is secured to a footboard;

(b) a primary mattress over said master bed frame, such that said primary mattress is positioned between said headboard and said footboard;

(c) at least one carriage assembly in engagement contact with said primary mattress and wherein said at least one carriage assembly is positioned between said headboard and said footboard;

(d) at least one means to move said at least one carriage assembly over said primary mattress from a first position to a second position, and wherein in said second position said at least one carriage assembly has at least one means to exert force onto said primary mattress so as to create a pocket below the substantially planar surface of said mattress.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

Figures 1A, 1B, 1C:
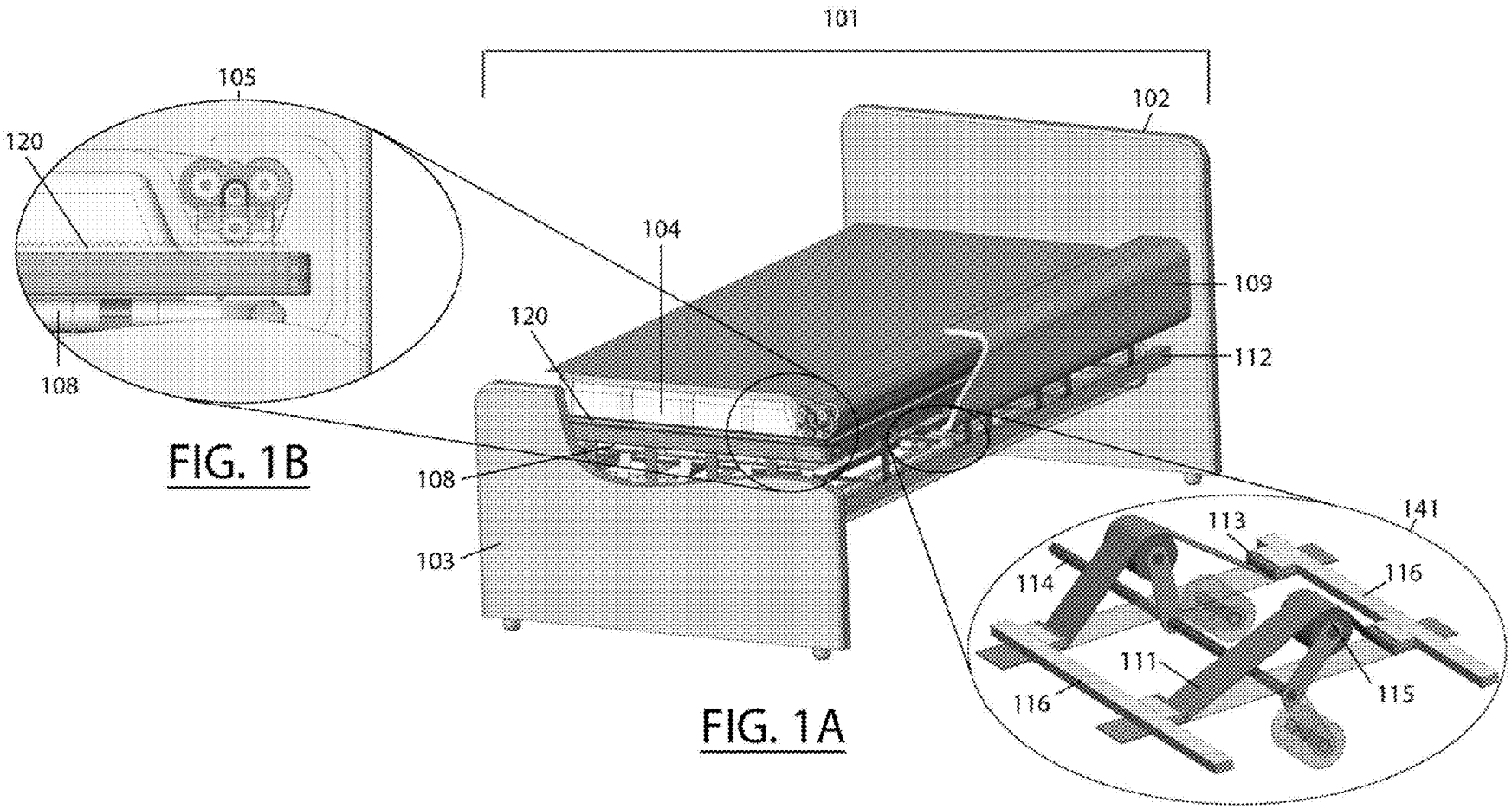
FIG. 1A, is a top elevation view of a hospital bed in accordance to one embodiment of the present invention in which the carriage assembly has been enlarged in FIG. 1B, to show greater detail, and tension pulley assembly has been enlarged in FIG. 1C, to show greater detail.

The embodiments of the present invention are described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein. Rather, the disclosed embodiments are provided so that this disclosure will be thorough and complete, and will fully convey the scope of the invention to those skilled in the art.

Throughout the specification and claims, the following terms take the meanings explicitly associated herein, unless the context clearly dictates otherwise. The phrase "in one embodiment" as used herein does not necessarily refer to the same embodiment, though it may. Furthermore, the phrase "in another embodiment" as used herein does not necessarily refer to a different embodiment, although it may. Thus, as described below, various embodiments of the invention may be readily combined, without departing from the scope or spirit of the invention.

As shown in this invention, having the straps or the belts or the bladders or the mechanical carriage allows a service provider or a caregiver or a healthcare provider a much better access or room under the patient to remove the pads or mats or bed sheets while the patient or the person was still on the medical or hospital bed.

It would be advantageous to provide a hospital bed capable of seamlessly changing bed sheets while occupied by a patient because; it would be convenient to patients, caregivers, and healthcare providers by avoiding the traditional method, such as turning patient and/or lifting patient. It will reduce the cost of care for bedridden patient by decreasing the time spend and the number of the caregiver needed to assist in changing bed sheets. It will enhance safety of patients and caregivers by decreasing the hazard of physical injury and decreasing the health hazard of exposure to biological materials. It will help prevent pressure ulcers. Changing the bed sheet without moving the patient will eliminate the friction and shearing which are considered as major factor in development of pressure ulcer. It will reduce physical, psychological and emotional suffering that the bed bound patient and family are exposed to by using the traditional methods of changing the bed sheet. It would further be advantageous to provide a hospital bed capable of seamlessly changing bed sheets while occupied by a patient because it will reduce the risk of contamination and transmission of infectious by increasing the frequency of changing the bed sheet and minimizing the caregiver contact with patient's body and secretion. Belts or straps can be used also with alternating bladder mattress to reduce or prevent pressure ulcers and to change bed sheets.

A hospital bed that changes bed sheets without moving the patient. Comprised of a bedstead (foot/headboard), deformable bed top, spool rack and roller shafts on both sides. The ends of the deformable bed top are fixed on the head and footboard. The bed is pressed into and between the roller axles by the spool rack which forms a tightened and leveled bed top that is sunken in the spool rack. The two bed sheets cover the bed from head to foot board into spool rack and rolling on a roller.

As shown in FIGS. 1A through 10, a hospital bed 101, is capable of seamlessly changing bed sheets while being occupied by a patient, which includes a headboard 102, and footboard 103, connected to one another via a master bed frame 112, on top of which there is attached a secondary bed frame 108, which utilizes a matrix of top belts 111, and bottom belts 110, which laterally and longitudinally cross above and below a primary mattress 104, respectively, and can be tightened and loosened by a tension pulley assembly 141, attached to the lower section of the master bed frame 112. When tightened, the bottom belts 110, raise up the primary mattress 104, while the top belts 111, pull down a section thereof, thus creating an empty pocket 50, into which a carriage assembly 105, can fit into. The carriage assembly 105, is thus able to traverse from one side of the bed 101, to the other, rolling up a used bed sheet 106, and rolling out a new bed sheet 107, simultaneously, as the tension pulley assembly 141, and tension shaft assembly tightens and loosens the top belts 111, and bottom belts 110, allowing the carriage assembly 105, space to freely move therein.

Figure 5A:
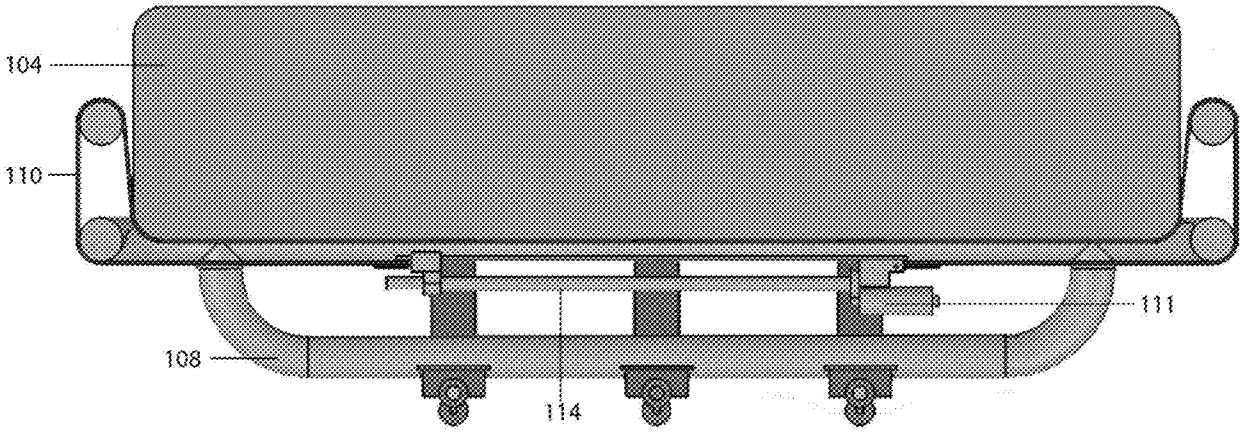
FIG. 5A is a front sectional view of a hospital bed in accordance to one embodiment of the present invention in which the tension shaft assembly is shown pulling bottom belts to raising up the primary mattress, which is shown in FIG. 5B.
Figure 5B:
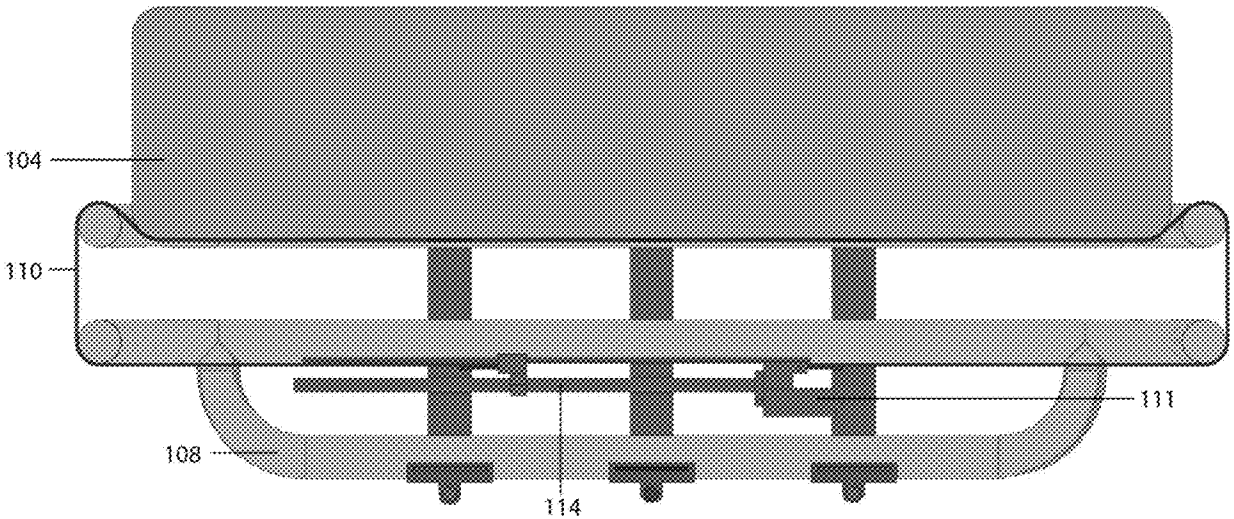

Referring now to the Figures, where FIG. 1A, is a top elevation view of a hospital bed 101, in accordance to one embodiment of the present invention in which the carriage assembly 105, has been enlarged in FIG. 1B, to show greater detail, and tension pulley assembly 141, has been enlarged in FIG. 1C, to show greater detail. Referring to FIGS. 1A, 1B, 1C, the hospital bed 101, includes a headboard 102 and footboard 103 held together by a master bed frame 112, on top of which there is mounted a secondary bed frame 108 which supports a primary mattress 104. Located under the master bed frame 112 is a tension pulley assembly 141 comprised of spline shaft 114, a shaft motor 142 and a series of primary belt rollers 115. These primary belt rollers 115 are affixed to a spline shaft 114 that is rotated by a shaft motor 142 and are offset from one another in such a way that as the spline shaft 114 turns, the primary belt rollers 115 apply pressure to the top belts 111 to pull down the primary mattress 104, while simultaneously pulling the bottom belts 110 in order to apply upward pressure to push up the primary mattress 104 to support the patient (not shown). As the carriage assembly 105 continues to be guided along the gear rack 120 via a series of gears, a mounting plate 124, a threaded rod 132 and a carriage motor 130, the top belts 111 in front of the carriage are tightened to create a new pocket 50, while the top belts 111 behind it are loosened and the bottom belts 110 provide support for the patient. In this way, the tension pulley assembly 141 is able to apply pressure to the various top belts 111 and bottom belts 110 to create moving pockets 50, large enough to allow the carriage assembly 105 to pass freely over the primary mattress 104 from one end of the bed to another without tension. Secondary belt rollers 113 are affixed to the cross frame bars 116 under the primary mattress 104 to allow the bottom belts 110 and top belts 111 to freely rotate under the cross frame bar and apply tension to the belts as required. A hinged carriage cover 109 used for storing and protecting both the carriage assembly 105 from being damage and the patient from being injured is also shown attached to the master bed frame 112. Hinged side rails 144, as shown in FIG. 5A, and FIG. 5B, are used for support and to protect the patient from falling out of bed will be attached to the master bed frame 112, and the hinged side rails 114, are capable of moving up and down or rotating around an axis, as is well known in the art.

Figures 2A, 2B:
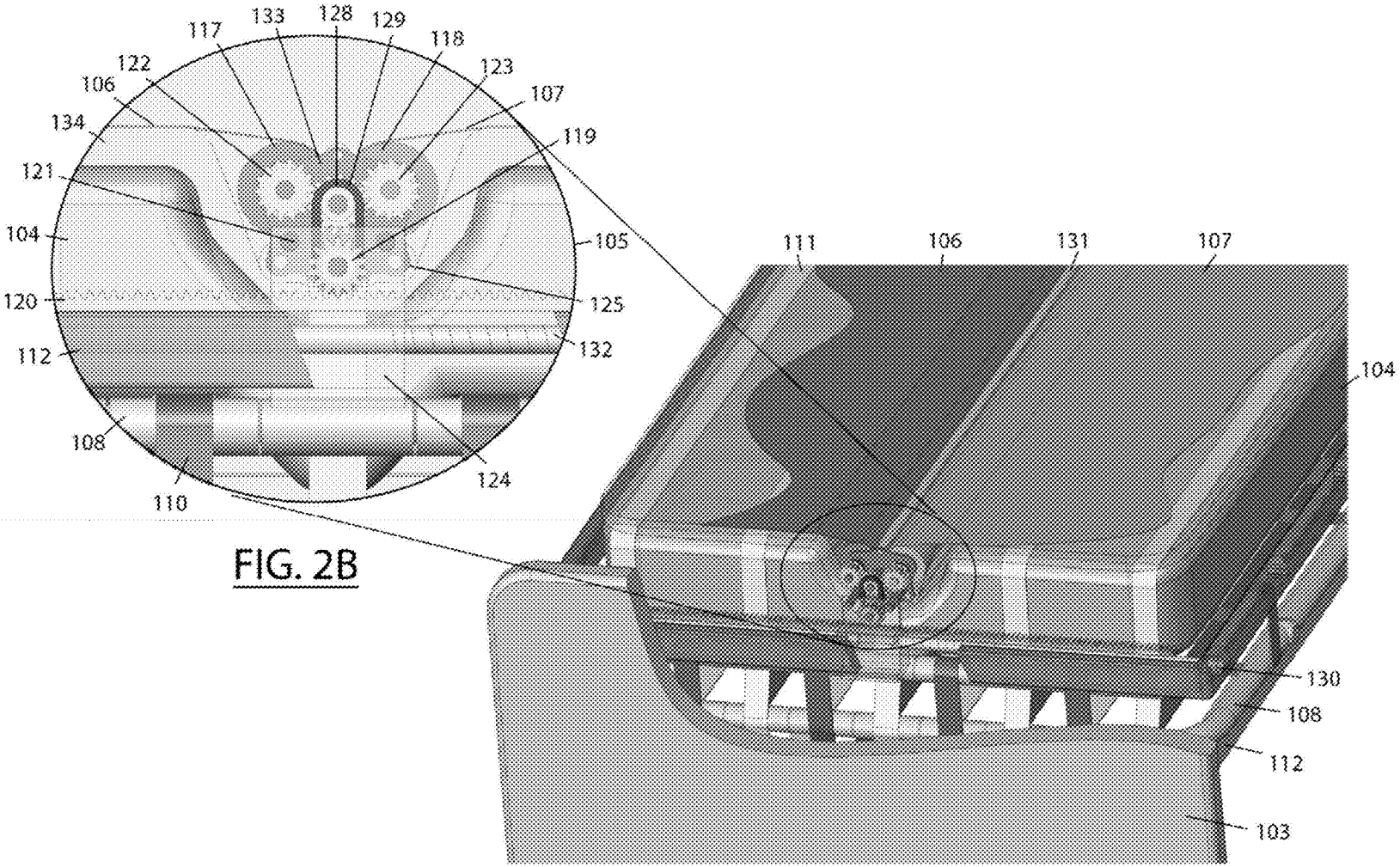
FIG. 2A is a top elevation view of a hospital bed in accordance to one embodiment of the present invention in which the carriage assembly is enlarged to show greater detail in FIG. 2B.

FIG. 2A shows hospital bed 101 in accordance to one embodiment of the present invention in which the carriage assembly 105 is enlarged to show greater detail in FIG. 2B. The carriage assembly 105 is held together by series of mounting rods 121 and a mounting bracket 133 on either end on the top of which there are inserted a used bed sheet roller 117 and a new bed sheet roller 118 parallel to one another. Between these bed sheet rollers and at a slightly higher level, there is located a padded support roller 131 which prevents the patient's back from touching the rotating bed sheet rollers as they simultaneously roll up the used bed sheet 106 and roll out the new bed sheet 107 as the carriage assembly 105 moves across the bed. Bearings 126 are placed throughout the holes of the mounting bracket 133 to facilitate the free rotation of the attached rollers and gears. The carriage assembly 105 also includes a series of belts, gears and slip clutches which work together to both move the carriage across the bed as well as complete the bed changing process at the same time. This is accomplished using a used bed sheet roller gear 122 and a new bed sheet roller gear 123 which are attached to both ends of the used bed sheet roller 117 and new bed sheet roller 118 respectively. A Slip clutch 125, is inserted onto either end of the bed sheet rollers between the mounting bracket 133 the roller gears to prevent bed sheet rollers from rotating when anything obstructs the rolling process the used and new bed sheets, in order to protect the patient and bed components from being injured and damaged. The used bed sheet roller gears 122 and new bed sheet roller gear 123 are connected via a center belt gear 128 located at the center of the mounting bracket 133. Depending on the direction of the rotation of the center belt gear 128, the bed sheet gears will either rotate clockwise or counter-clockwise in conjunction with the movement of the carriage assembly 105 in such a way that the used bed sheet roller 117 rolls up the used bed sheet 106 while the new bed sheet roller 118 rolls up the new bed sheet 107. The center belt gear 128 is connected to the master rack gear 127 via a center belt 129 which transfers the rotation of the master rack gear 127 to the center belt 129 which in turn, rotates both bed sheet gears. The master rack gear 127 engages a gear rack 120 affixed the upper section of the master bed frame 112. The carriage assembly 105 is moved from one end of the bed to the other by a carriage motor 130 to which there is attached a threaded rod 132. At the base of the mounting plate 124 there is attached a threaded hole 135 into which the threaded rod 132 is inserted. As the threaded rod 132 rotates, so does the master rack gear 127, moving the carriage along the sides of the bed and starting the bed changing process. A master rack gear 127 is affixed to both ends of a master pressure roller 119 that works in conjunction with the top belts 111 to to apply downward pressure on the top mattress 134 and primary mattress 104 to create clearance for the carriage assembly 105 to freely move across the bed. A top mattress 134 is placed above the top belts 111 that matrix the primary mattress 104 in order to provide extra comfort for the patient and prevent their back from coming in direct contact with top belts 111. For safety reasons, gear cover 143, shown in FIG. 1B, is used to cover all exposed gears and belts of the carriage assembly 105.

Figures 3A, 3B, 3C:
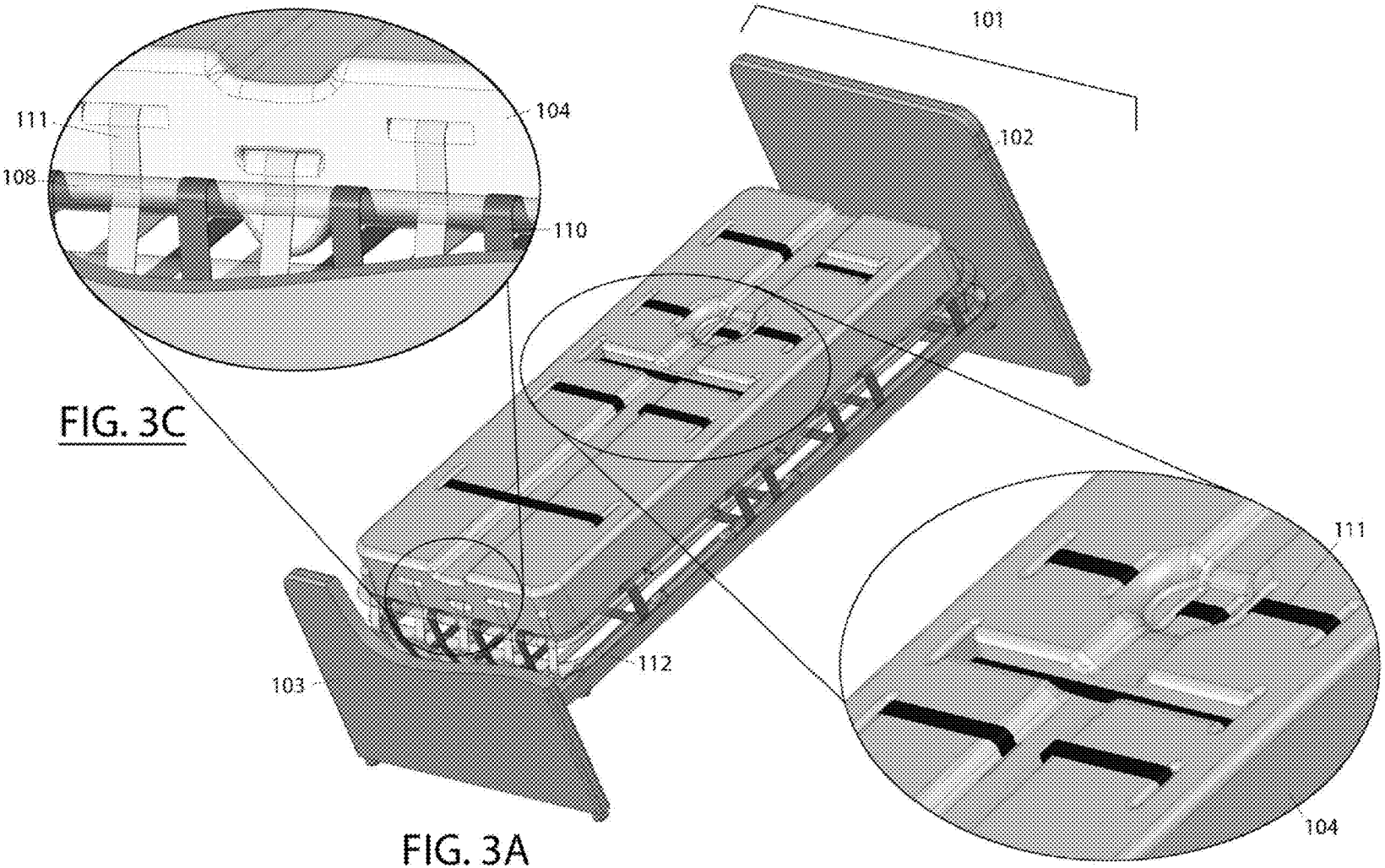
FIG. 3A is a top elevation view of a hospital bed in accordance to a second embodiment of the present invention in which the top belts go through the primary mattress as shown in FIG. 3B, and are enlarged along with the bottom belts to show greater detail in FIG. 3C.

FIG. 3A is a top elevation view of a hospital bed 101 in accordance to a second embodiment of the present invention in which the top belts 111 go through, instead of over, the primary mattress 104, as shown in FIG. 3B, and are enlarged along with the bottom belts 110, to show greater detail, as shown in FIG. 3C. In either embodiment, the top belts 111 and bottom belts 110 can work together to not only aid the carriage assembly's uninhibited movement across the bed, but also to create customizable pressure relief zones that relieve pressure from particular areas of the body that are weak, tender, sore, infected, or need to heal.

Figure 4A:
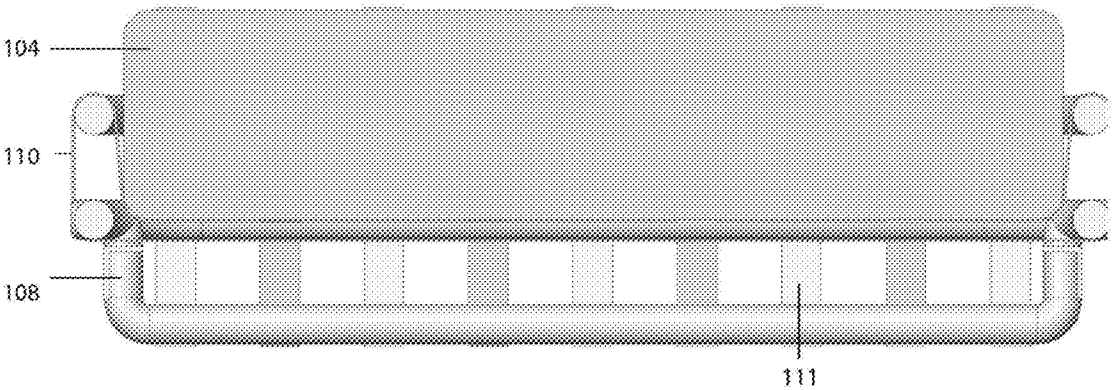
FIG. 4A is a front sectional view of a hospital bed in accordance to one embodiment of the present invention in which bottom belts are shown raising the primary mattress and top belts are shown pulling down the primary mattress to create pockets which are shown in FIG. 4B.
Figure 4B:
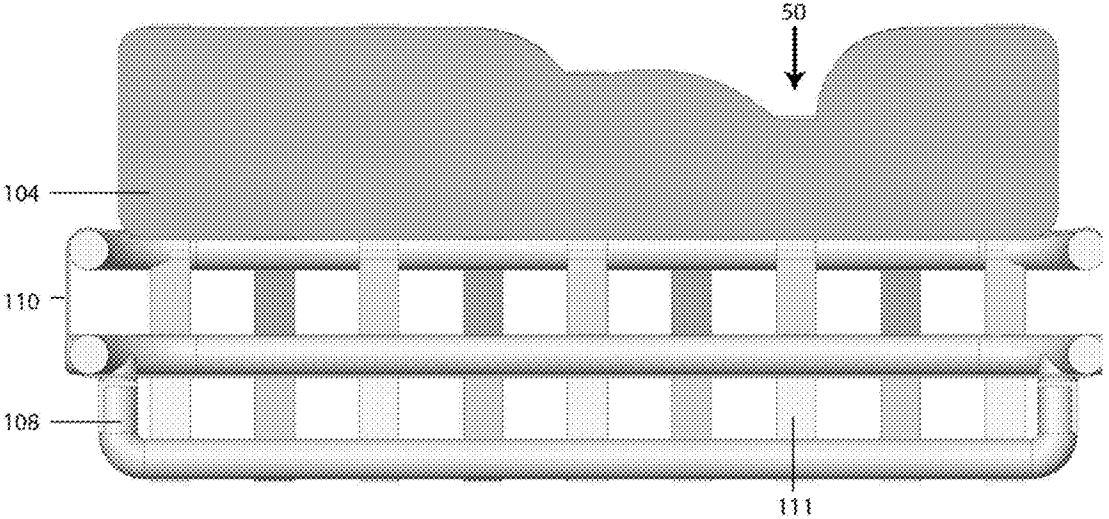

FIG. 4A is a front sectional view of a hospital bed 101 in accordance to one embodiment of the present invention in which bottom belts 110 are shown raising the primary mattress 104 and top belts 111 are shown pulling down the primary mattress 104 to create pocket 50, as more clearly shown in FIG. 4B.

FIG. 5A is a front sectional view of a hospital bed 101 in accordance to one embodiment of the present invention in which the shaft motor 142 and spline shaft 114 of the tension pulley assembly is shown applying tension to the bottom belts 110 to raising up the primary mattress 104, as more clearly shown in FIG. 5B.

Figure 6A:
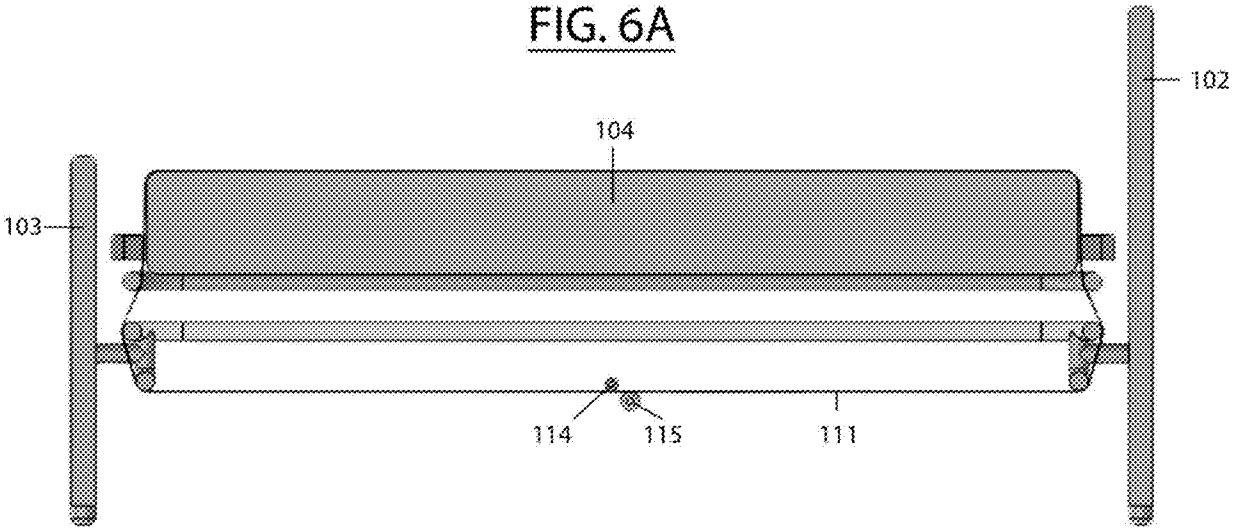
FIG. 6A is a right sectional view of a hospital bed in accordance to one embodiment of the present invention in which the tension pulley assembly is shown pulling top belts to pulling down the primary mattress, which is shown in FIG. 6B.
Figure 6B:
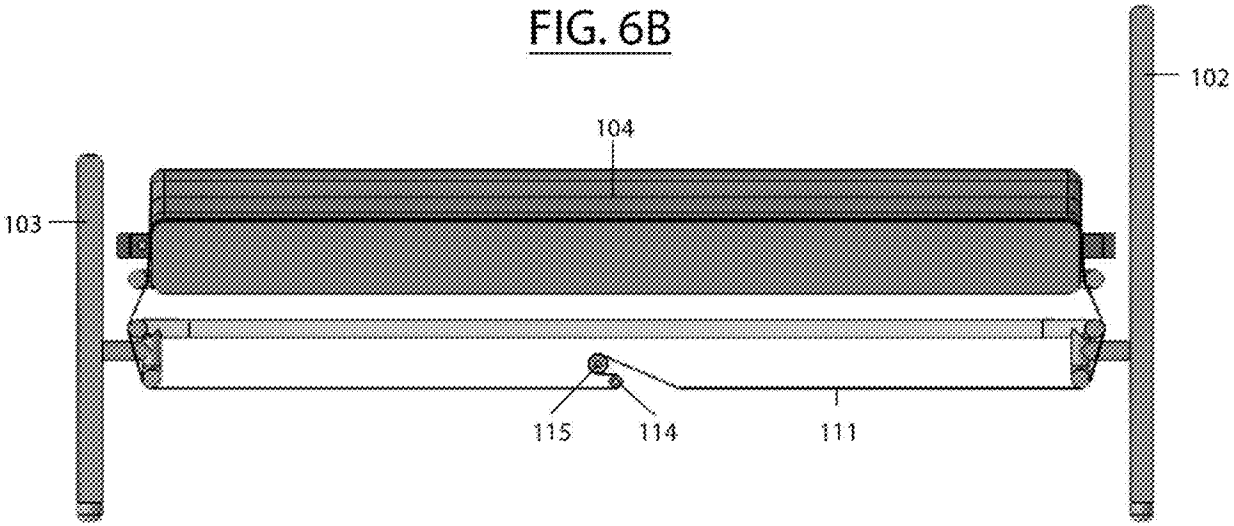

FIG. 6A is a right sectional view of a hospital bed 101 in accordance to one embodiment of the present invention in which the primary belt rollers 115 and spline shaft 114 of the tension pulley assembly is show applying tension to the top belts 111 and pulling down the primary mattress 104, as more clearly shown in FIG. 6B. In another embodiment, the primary pressure rollers and spline shaft 114 of the tension pulley assembly 141 could be replaced with another a threaded hole 135 and threaded rod 132 turned by the shaft motor 142 in order to tighten and loosen the bottom and top belts 111.

Figure 7:
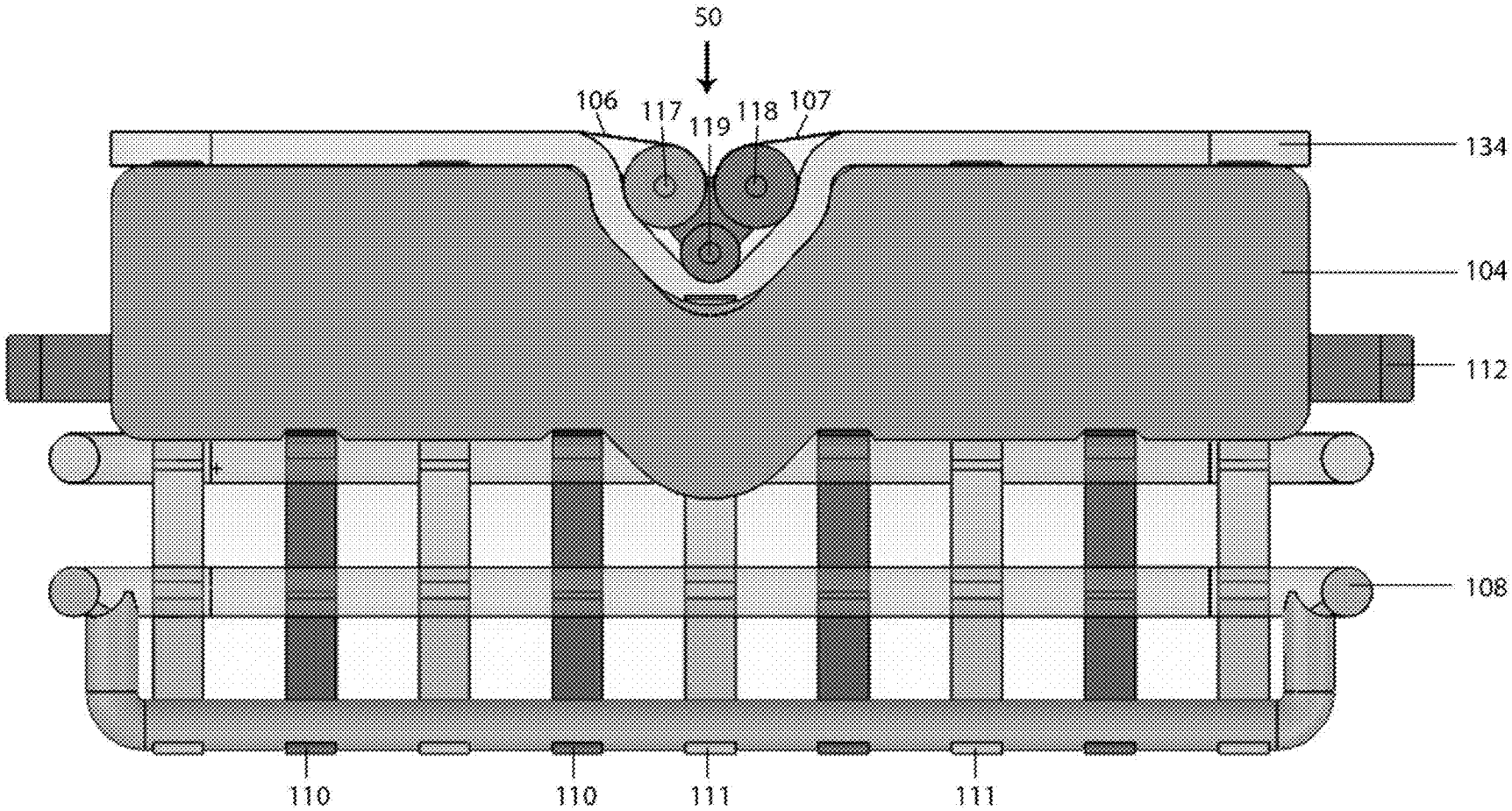
FIG. 7 is a front sectional view of a hospital bed in accordance to one embodiment of the present invention in which the pressure roller is shown working in conjunction with the top pulling to create a pocket in the primary mattress for the carriage assembly to fit.

FIG. 7 is a front sectional view of a hospital bed 101 in accordance to one embodiment of the present invention in which the master pressure roller 119 is shown working in conjunction with the top belts 111 to apply downward pressure on the top mattress 134 and primary mattress 104 in order to create a pocket 50, for the carriage assembly 105 to fit.

Figure 8:
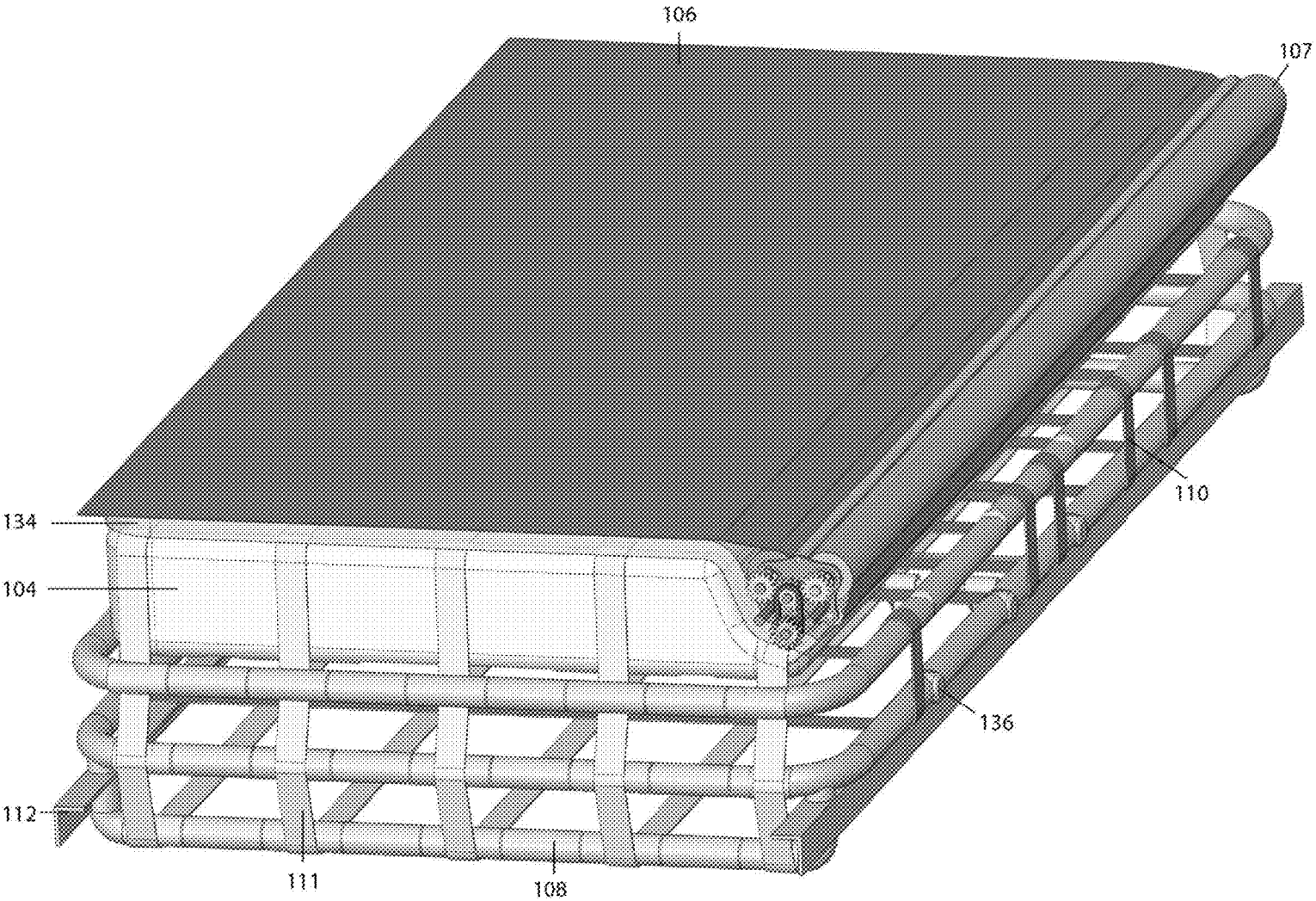
FIG. 8 is a top elevation view of a hospital bed in accordance to one embodiment of the present invention in which the carriage assembly is show parked at the far right of the hospital bed.
Figures 9A, 9B:
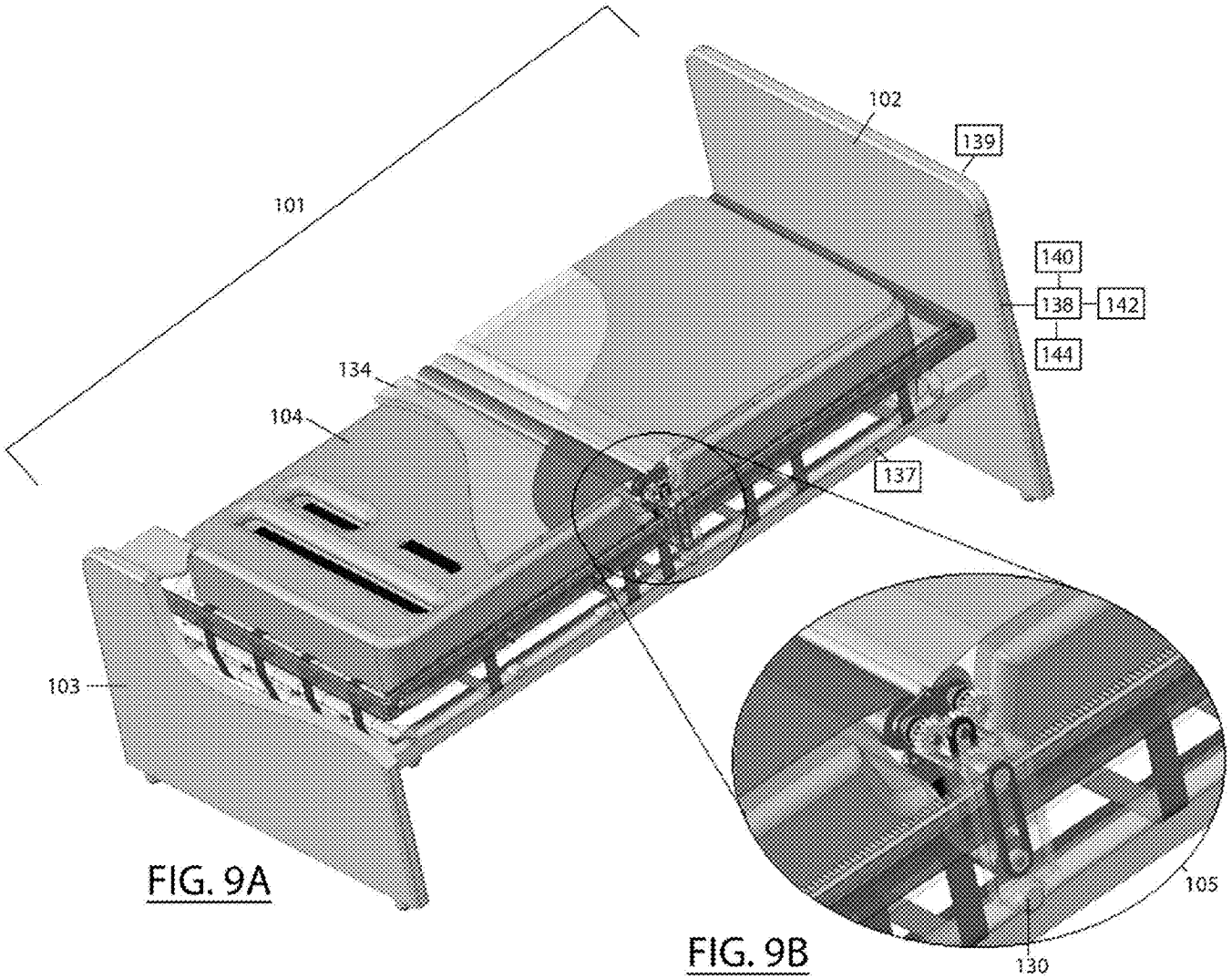
FIG. 9A is a top elevation view of a hospital bed in accordance to another embodiment of the present invention in which the carriage assembly is enlarged to show greater detail in FIG. 9B.

FIG. 8 is a top elevation view of hospital bed 101 in accordance to one embodiment of the present invention in which the carriage assembly 105 is show parked at the far right of the hospital bed 101. Along the bottom of the secondary mattress frame there is shown a series of mattress frame hinges 136 which are used to raise and lower the head and back area and leg and feet areas of the secondary mattress frame much like a traditional hospital bed 101. The mattress frame hinges 136 move via the turning of a mattress frame motor 137, as shown in FIG. 9A, attached to the secondary bed frame 108 and is operated by hand remote 139, as shown in FIG. 9A. In another embodiment, the beds operation can also be voice operated.

FIG. 9A is a top elevation hospital bed 101 in accordance to another embodiment of the present invention in which the carriage assembly 105, is enlarged to show greater detail in FIG. 9B. In this embodiment, the carriage motor 130 is attached directly to the carriage assembly 105, via the mounting plate 124, giving the carriage assembly 105 the ability to move across the bed on its own without the use of a threaded rod 132. For some applications the medical or hospital bed 101, would have a control box 138, a central processing unit (CPU) 140, a power supply 142, and a programming logic controller (PLC) 144. Located within the control box 138, there is a CPU 140, a power supply 142, and any other necessary parts to make the hospital bed 101, function along with a programmable logic control 144, to determine the sequence of operation for the entire hospital bed 101. Preferably, the medical or hospital bed 101, would have a hand remote 139, to operate several of the features of the inventive bed 101. For some applications the medical or hospital bed 101, would also have a mattress frame motor 137.

Figure 10:
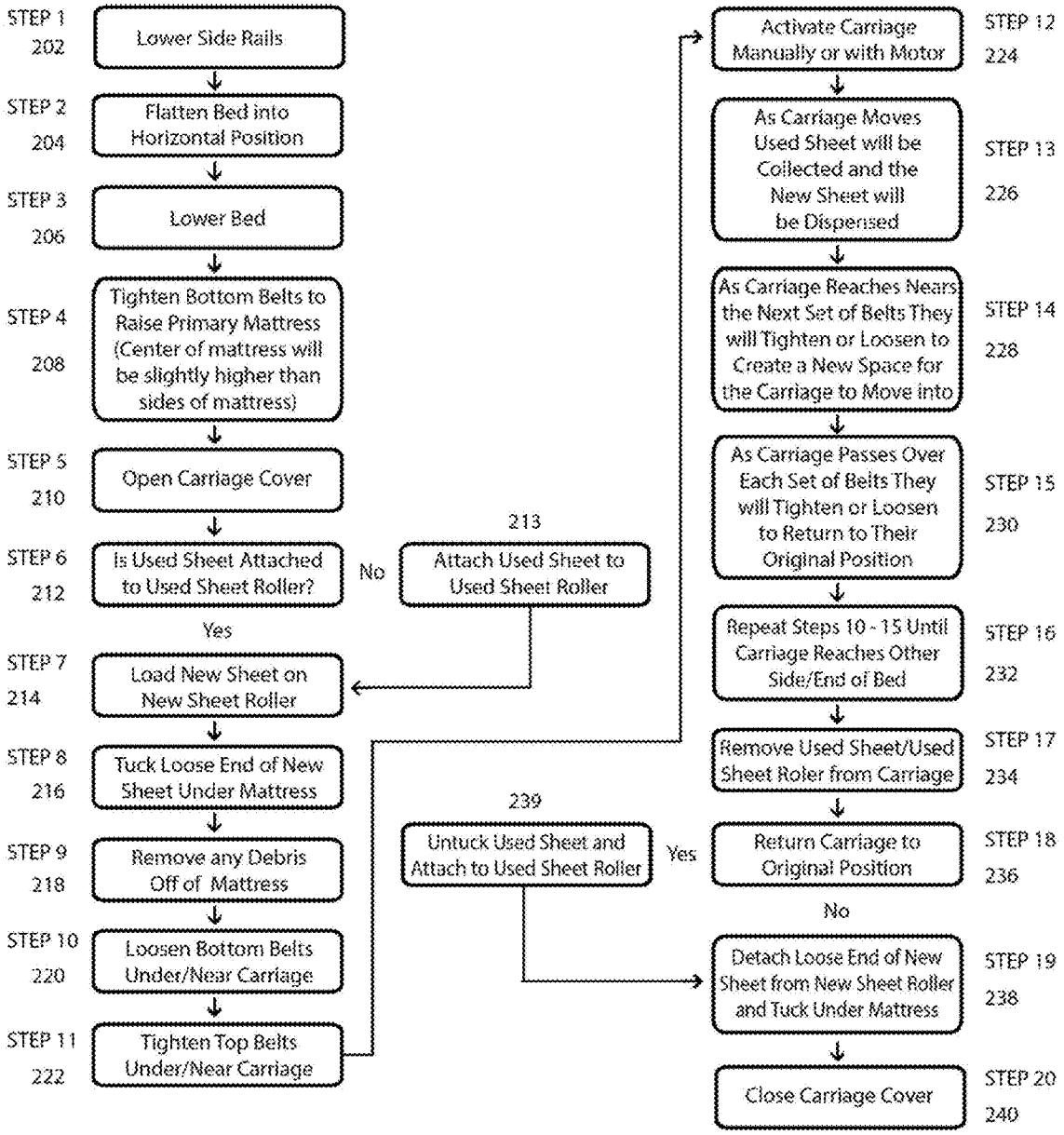
FIG. 10 is a block diagram explaining the sequence of operation for the entire bed including, but not limited to its ability to enable the bed frame assembly, carriage assembly and tension pulley assembly to function together in such a way as to facilitate the uninhibited movement of the carriage assembly across the bed to collect used bed sheets and dispense new bed sheets.

FIG. 10 is a block diagram explaining the sequence of operation for the entire bed 101, including, but not limited to its ability to enable the bed frame assembly, carriage assembly 105, and tension pulley assembly 141, to function together in such a way as to facilitate the uninhibited movement of the carriage assembly 105, across the bed 101, to collect used bed sheets 106, and dispense new bed sheets 107. In step 1, 202, one would lower side rails 108, and then in step 2, 204, one would flatten the bed 101, into a horizontal position. In step 3, 206, the bed 101, would be lowered, and in step 4, 208, one would tighten the bottom belts 110, to raise primary mattress 104, during this process the center of the mattress will be slightly higher than the sides of the mattress. In step 5, 210, one would open the carriage cover. In step 213, one would attach the used bed sheet 106, onto the used bed sheet roller 117, and then in step 7, 214, one would load the new bed sheet 107, onto the new bed sheet roller 118. In step 8, 216, one would tuck the loose end of the new bed sheet 107, under the mattress. In step 9, 218, one would remove any debris off the mattress 101. In step 10, 220, one would loosen bottom belts 110, under and the near the carriage 105. In step 11, 222, one would tighten top belts 111, under or near the carriage 105. In step 12, 222, one would activate the carriage 105, manually or using a motor 137. In step 13, 226, as the carriage 105, moves the used bed sheets 106, and they will be collected and the new bed sheets 107, will be dispensed onto the mattress 101. In step 14, 228, as the carriage 105, moves and reaches near the next set of belts 110, 111, one would then tighten or loosen the belts 110, 111, to create new space or pocket 50, for the carriage 105, to move into. In step 15, 230, as the carriage 105, passes over each set of belts 110, 111, one would tighten or loosen the belts 110, 111, to return them to their original position. In step 16, 232, one would repeat step 10, 220, to step 15, 230, until the carriage 105, reaches the other side or end of the bed 101. In step 17, 234, one would remove the used bed sheets 106, from the used bed sheet roller 117, from the carriage 105. In step 18, 236, one would return the carriage 105, to the original position. In step 19, 238, one would detach the loose end of the new bed sheet 107, from the new bed sheet roller 118, and tuck it under the mattress 101. In step 239, one would untuck the used bed sheet 106, from the used bed sheet roller 117, and attach the used bed sheet roller 117, back into the carriage 105. In step 20, 240, one would close the carriage cover.

A carriage assembly is used in conjunction with the tension pulley assembly to create a space or pocket in which to move vertically and/or horizontally across the top of primary mattress in order to dispense and collect new and used bed sheets without disturbing the patient occupying the bed space, and also to apply pressure onto the surface of the primary mattress allowing the carriage assembly to move freely across the hospital or medical bed. Although the patient is not shown, it is to be understood that the space or pocket that is created by the carriage assembly in conjunction with the tension pulley assembly will enable the uninhibited movement of the carriage assembly under the patient to completed the bed sheet changing process as shown in the Figures, and more specifically as shown in FIGS. 2, 7, and 9A-9B.

A tension pulley assembly is used for maneuvering a series of top and bottom belts to deform the primary mattress in order to create space or pocket into which the carriage assembly can pass freely over the primary mattress in order to complete the bed sheet changing process, and/or to relieve pressure from the patient's neck, shoulder, buttocks, and foot areas, or to reduce the likelihood of bedsores, and/or other similar pressure related conditions, and/or to facilitate patient healing. Although the patient is not shown, it is understood that the space or pocket created by the maneuvering of the tension pulley assembly will remove pressure from underneath specific areas of the patient, and the carriage assembly as shown in the Figures, and more specifically as shown in FIGS. 1, 3A-3B, 4A-4B, and 6A-6B.

A hospital bed for seamlessly changing bed sheets while occupied by a patient, comprises:

(a) a bed frame assembly for providing physical support to patients, facilitate patient healing and work in conjunction with the carriage assembly and tension pulley assembly to seamlessly change bed sheets while occupied by a patient, wherein said bed frame assembly comprises:

(b) a means in said bed frame assembly for adjusting the height and angle of a primary mattress and/or independent sections thereof through the use of belts, motors and hinges aligned along a secondary mattress frame either vertically and/or horizontally;

(c) a means in said bed frame assembly for storing and protecting both the carriage assembly from damage and the patient from being injured:

(d) a means in said bed frame assembly for holding a headboard, side rails and a footboard together, support the secondary mattress frame and can utilize horizontal and/or vertical cross frame bars;

(e) a means in said bed frame assembly for allowing bottom belts and top belts to freely rotate under cross frame bars and apply tension to these belts as required;

(f) a means in said bed frame assembly for supporting a tension pulley assembly and strengthening the secondary mattress frame; it will be mounted to the secondary mattress frame and placed above top belt with two rollers at belt location and will be connected to said means for allowing the bottom belts and top belts to rotate under the cross frame bar and apply tension to the belts as required;

(g) a means in said bed frame assembly for lifting and lowering of the secondary mattress frame as a whole or sections thereof, connected to said means for adjusting the height and angle of the primary mattress and/or independent sections thereof;

(h) a means in said bed frame assembly for raising and lowering the head/back and leg/feet areas of the secondary mattress frame, connected to said means for lifting and lowering of the secondary mattress frame as a whole or sections thereof;

(i) a means in said bed frame assembly for containing the CPU, sensors, power supply and any other necessary parts to make the hospital bed function;

(j) a means in said bed frame assembly for allowing the patient and/or caregiver to control the movement of various parts of the bed and to relieve pressure from specific areas thereof; and (k) a means in said bed frame assembly for supporting and protecting the patient from falling out of bed will be attached to the master bed frame.

A hospital bed for seamlessly changing bed sheets while occupied by a patient, comprising:

(a) a carriage assembly for moving vertically and/or horizontally across the top of the hospital bed in order to dispense and collect new and used bed sheets without disturbing the patient occupying the bed space and to apply pressure to mattress allowing said carriage assembly to move freely across the bed, wherein said carriage assembly comprises;

(b) a means in said carriage assembly for collecting the used bed sheets consisting of a removable rod that will rotate either counter clock-wise (ccw) or clock-wise (cw) depending on the motion of said carriage assembly;

(c) a means in said carriage assembly for dispensing the new bed sheet consisting of a removable rod that will rotate either counter clock-wise (ccw) or clock-wise (cw) depending on the motion of the carriage assembly;

(d) a means in said carriage assembly for applying downward pressure on top mattress and primary mattress to create clearance for the carriage assembly to freely move across the bed. Works in conjunction with the top belts;

(e) a means in said carriage assembly for providing the master rack gear with a means of moving the carriage assembly linearly along the bed frame; the carriage assembly contains a circular rack gear that rests on rack and enables the carriage to travel along the rack as the circular gear rotates, turning rotational motion into linear action;

(f) a means in said carriage assembly for holding the mounting plates on either end of the carriage assembly together;

(g) a means in said carriage assembly for rotating the used bed sheet roller when the master rack gear rotates, connected to said means for rolling up the used bed sheet;

(h) a means in said carriage assembly for rotating the new bed sheet roller when the master rack gear rotates, connected to said means for rolling up the new bed sheet;

(i) a means in said carriage assembly for guiding the carriage along to the gear rack via a threaded hole that interacts with threaded rod to reduce slippage, connected to said means for holding the headboard and the footboard together;

(j) a means in said carriage assembly for slipping and thereby preventing said roller from rotating when anything obstructs the rolling process dispensing and collecting the two said bed sheets, in order to protect the patient and bed components from being injured/damaged, connected to said means for rotating the new bed sheet roller when the master rack gear rotates, connected to said means for rotating the used bed sheet roller when the master rack gear rotates;

(k) a means in said carriage assembly for allowing the rotation of the various rollers, gears and pulleys used throughout the hospital bed;

(l) a means in said carriage assembly for engaging the gear rack in order to move the carriage assembly along the bed;

(m) a means in said carriage assembly for rotating the center belt in order to turn the master rack gear;

(n) a means in said carriage assembly for rotating the master gear when the center belt gear rotates;

(o) a means in said carriage assembly for rotating the threaded rod to move the carriage assembly across the bed;

(p) a means in said carriage assembly for holding both sides of carriage assembly together as well as preventing the patient from touching the rotating bed sheet rollers;

(q) a means in said carriage assembly for moving the carriage assembly along gear rack, connected to said means for rotating the threaded rod to move the carriage assembly across the bed;

(r) a means in said carriage assembly for holding all the different parts of the carriage assembly together;

(s) a means in said carriage assembly for providing additional comfort and protection for the patient, placed between top belts and patient body; and (t) a means in said carriage assembly for guiding the carriage along the threaded rod parallel to the gear rack, threadably inserted to said means for moving the carriage assembly along gear rack, and structurally embedded to said means for guiding the carriage along to the gear rack via a threaded hole that interacts with threaded rod to reduce slippage.

A hospital bed for seamlessly changing bed sheets while occupied by a patient, comprising:

(a) a tension pulley assembly for elevating the primary mattress to support the patient, while simultaneously pulling down sections thereof to create pockets 50, for comfort for the patient and to allow the carriage assembly to pass freely over it to complete the bed sheet changing process and to relieve pressure from the patient's body to reduce the likelihood of bedsores and/or other similar pressure related conditions, wherein said tension pulley assembly comprises;

(b) a means in said tension pulley assembly for applying pressure or tension to the bottom belts to elevate the primary mattress to support the patient, and the top belts to pull down on the primary mattress to create pockets 50, for comfort and/or to allow the carriage assembly to pass freely over it, connected to said means for moving the primary belt rollers so that they can apply pressure to the bottom belts and top belts;

(c) a means in said tension pulley assembly for creating an indentation along the primary mattress vertically, horizontally and/or diagonally allowing the carriage assembly to move across the top of the primary mattress and to relieve pressure from the patient;

(d) a means in said tension pulley assembly for moving the primary belt rollers so that they can apply pressure to the bottom belts and top belts;

(e) a means in said tension pulley assembly rotating the spline shaft of the tension pulley assembly; and (f) a means in said tension pulley assembly for covering the uppermost gears of the carriage assembly.

A hospital bed for seamlessly changing bed sheets while occupied by a patient, comprising:

(a) a programmable logic controller and/or microprocessor for determining the sequence of operation for the entire bed including, but not limited to its ability to enable the bed frame assembly, carriage assembly and tension pulley assembly to function together in such a way as to facilitate the uninhibited movement of the carriage assembly across the bed to collect used bed sheets and dispense new bed sheets; this is accomplished by first tightening a series of bottom belts to elevate the primary mattress via the tension pulley assembly, creating an empty space between the primary mattress and the secondary bed frame of the bed frame assembly; as the carriage assembly traverses the bed pressing down on the top of the primary mattress, top belts of the tension pulley assembly simultaneously pull down on the primary mattress, thereby creating a pocket 50, in the newly created space between the bottom of the primary mattress and the secondary bed frame in which the carriage assembly is now able to move without significant resistance.

Thus, the present invention is not limited to the embodiments described herein and the constituent elements of the invention can be modified in various manners without departing from the spirit and scope of the invention. Various aspects of the invention can also be extracted from any appropriate combination of a plurality of constituent elements disclosed in the embodiments. Some constituent elements may be deleted in all of the constituent elements disclosed in the embodiments. The constituent elements described in different embodiments may be combined arbitrarily.

Still further, while certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A medical bed apparatus for seamlessly changing bed sheets and relieving pressure underneath an occupying patient, comprising:

(a) a master bed frame having a first end and a second end, wherein said first end is secured to a headboard, and said second end is secured to a footboard;

(b) a primary mattress over said master bed frame, such that said primary mattress is positioned between said headboard and said footboard;

(c) at least one carriage assembly in engagement contact with said primary mattress and wherein said at least one carriage assembly is positioned between said headboard and said footboard;

(d) at least one means to move said at least one carriage assembly over said primary mattress from a first position to a second position; and (e) at least one tension pulley assembly in engagement with at least one first belt under said primary mattress and at least one second belt over said primary mattress, wherein the at least one tension pulley assembly is configured to exert a downward tension on the at least one second belt so as to form a pocket in the mattress within which the at least one carriage assembly resides when in the first position.

2. The medical bed apparatus of claim 1, wherein said first position is substantially parallel to an upper surface of said primary mattress.

3. The medical bed apparatus of claim 1, wherein said first position is substantially parallel to an upper surface of said primary mattress, and said second position is below said upper surface of said primary mattress.

4. The medical bed apparatus of claim 1, wherein at least one used bed sheet covers at least a portion of said primary mattress, and wherein said carriage assembly has at least one means to securely engage an edge of said at least one used bed sheet.

5. The medical bed apparatus of claim 1, wherein said carriage assembly has at least one means to dispense at least one new bed sheet over said primary mattress.

6. The medical bed apparatus of claim 1, wherein said movement of said at least one carriage assembly over said primary mattress from said first position to said second position creates a pocket in said primary mattress.

7. The medical bed apparatus of claim 1, wherein said movement of said at least one carriage assembly over said primary mattress from said first position to said second position creates a pocket in said primary mattress, and wherein a new bed sheet is rolled out in said pocket and dispensed on the upper surface of said primary mattress, and a used bed sheet is proportionally removed from the surface of said primary mattress.

8. The medical bed apparatus of claim 1, wherein in said second position of said at least one carriage assembly has at least one means to exert force onto said primary mattress so as to create a pocket below a substantially planar surface of said mattress.

9. The medical bed apparatus of claim 8, wherein said at least one means to exert said force is at least one pressure roller, and wherein said at least one pressure roller is in engagement contact with said at least one carriage assembly.

10. The medical bed apparatus of claim 1, wherein said at least one tension pulley assembly has at least one means to pull down sections of said primary mattress.

11. The medical bed apparatus of claim 1, wherein said at least one tension pulley assembly has at least one means to elevate a section of said primary mattress.

12. The medical bed apparatus of claim 1, wherein movement of said at least one tension pulley assembly elevates a section of said primary mattress.

13. The medical bed apparatus of claim 1, wherein said at least one tension pulley assembly has at least one means to exert force under said primary mattress so as to elevate a section of said primary mattress.

14. The medical bed apparatus of claim 13, wherein said elevated section of said primary mattress provides physical support to the patient's body to facilitate patient comfort and healing when said pocket has been created below said patient during the bed sheet changing and pressure relief process.

15. The medical bed apparatus of claim 1, wherein said at least one first belt under said primary mattress supports the full weight of said primary mattress and the patient.

16. A bed, comprising:

a mattress;

a carriage assembly comprising a carriage motor coupled to a gear assembly, wherein the motor and gear assembly are configured to move the carriage assembly across the mattress, and wherein the carriage assembly further comprises first and second sheet rollers coupled to the gear assembly, wherein the first sheet roller is configured to collect a used bed sheet from the mattress and the second sheet roller is configured to dispense a new bed sheet onto the mattress as the carriage assembly moves across the mattress from a first position to a second position; and a tension pulley assembly comprising at least first and second belts, wherein the belts are positioned over portions of the mattress along first and second substantially parallel lengths, wherein the tension pulley assembly is configured to exert a downward tension on the first belt, thereby pulling down that portion of the mattress along the first length and creating a first lengthwise pocket in the mattress into which at least a portion of the carriage assembly resides in its first position, and as the carriage assembly moves from the first position to the second position, the tension pulley assembly is further configured to exert a downward tension on the second belt, while releasing the downward tension on the first belt, thereby pulling down that portion of the mattress along the second length and creating a second lengthwise pocket in the mattress into which at least a portion of the carriage assembly resides in its second position.

17. The bed of claim 16, wherein the tension pulley assembly further comprises a third belt positioned under a portion of the mattress between the first and second belt along a third length, which is substantially parallel to the first and second lengths.

18. The bed of claim 16, wherein the carriage assembly is configured to move across the mattress from side to side, or from head to foot.

* * * * *